United States Patent [19]

Sasse

[11] Patent Number: 4,541,631

[45] Date of Patent: Sep. 17, 1985

[54] GOLF CLUB

[76] Inventor: Howard A. Sasse, 2101 Sandhills Blvd., Southern Pines, N.C. 28387

[21] Appl. No.: 538,538

[22] Filed: Oct. 3, 1983

[51] Int. Cl.[4] ..... A63B 53/08; A63B 69/36

[52] U.S. Cl. ..... 273/170; 273/186 A

[58] Field of Search ..... 273/170, 186 A, 171, 273/172, 194 R, 194 B

[56] References Cited

U.S. PATENT DOCUMENTS

| | | | |
|---|---|---|---|
| 1,894,841 | 1/1933 | Adams | 273/170 |
| 3,037,775 | 6/1962 | Busch | 273/170 |
| 3,572,706 | 3/1971 | Schroder | 273/186 A |

*Primary Examiner*—George J. Marlo

*Attorney, Agent, or Firm*—Donald C. Studley

[57] ABSTRACT

The present application relates to a golf club having a hollowed head portion connected to a hollow shaft portion forming a sealed, internal chamber within the club. A flowable weight is positioned within the chamber. A two way valve allows the flowable weight to pass therethrough and into the hollowed head portion by centrifugal force as the club is swung, and allows the flowable weight to return from the hollowed head portion by passing through the valve by gravity as the club is inverted.

3 Claims, 3 Drawing Figures

GOLF CLUB

BACKGROUND AND PRIOR ART

The present invention relates to an improved golf club. Golf and football, are games of inches, golf however, has more of them. Standard golf courses, usually over about 6,000 yards long, are divided into holes of varying length. The object of the game is to complete the course in as few strokes as possible. The initial stroke on each hole, usually taken from a tee, and the strokes approaching the green are taken by the golfer with distance in mind. The present club is designed to give the golfer increased distance in such situations, without radically changing the golfer's style. The increased distance allows the golfer to complete the course in fewer strokes resulting in a lower score.

Previously a number of proposals have been made to improve distance, by balanced clubs or by clubs having various static weight distributions. For example: U.S. Pat. Nos. 1,526,951; 2,395,837 and 3,368,812.

BRIEF DESCRIPTION OF THE INVENTION

The present golf club is equipped with a means of changing the weight distribution in the club as the club is swung. This is accomplished by a moveable weight within the club. The golfer starts his swing with the moveable weight close to his hands. This arrangement allows the golfer to rapidly move the relatively lighter club head through the initial portion of his swing. As the swing is continued the weight moves toward, and preferably into, the club head. As contact is made with the ball, the moveable weight is substantially completely in the lower shaft or head portion of the club.

The golf swing can be considered to be an arc circumscribed by the club head. The moveable weight starts at a point near the golfer's hands and moves toward the arc. The weight reaches a point contiguous with the arc at about 5 o'clock as the arc would be viewed by the golfer. The point of contact with the ball is at 6 o'clock.

After the stroke, the club is placed in a golf bag in the normal grip-down position. In this position the weight returns to the grip portion of the club, usually within a period between about 10 and about 30 seconds. The club is again ready for use.

The weight shift is accomplished by means of a flowable weight moving internally within a chamber, or cavity, in the club shaft and which extends into the club head. At the start of the swing, the flowable weight is in the grip portion of the club shaft. As the swing progresses the weight moves through the chamber into the lower shaft and head portion of the club. At the point of contact with the ball the flowable weight, is preferably substantially completely within the club head.

As the club is removed from the golf bag for use, a valve means prevents the weight from flowing downward into the club head. As the club is swung the valve means, preferably operable by centrifugal force, allows the weight to move toward the club head. The position of the weight at the start of the swing allows the golfer to move the club heat at a higher initial angular velocity than if the weight were concentrated in the club head, or distributed over the entire club. As the swing progresses the weight moves toward, and preferably into, the club head, giving the golfer a quicker swing. The required added weight in the head, with the added head space, will upon contact with the ball, drive the ball a greater distance.

The present invention may be incorporated into commercially available clubs without a substantial change in outward appearance.

Although the present invention is particularly suited to drivers and woods, it will be understood that it is also adaptable and useful in other golf clubs, e.g., the so-called "irons".

DETAILED DESCRIPTION OF THE INVENTION

The invention will now be described in conjunction with the accompanying drawings in which FIG. 1 is a frontal fractionated view, partly in section, of a club of the present invention as the club would appear as prepared for use.

Figure 1:
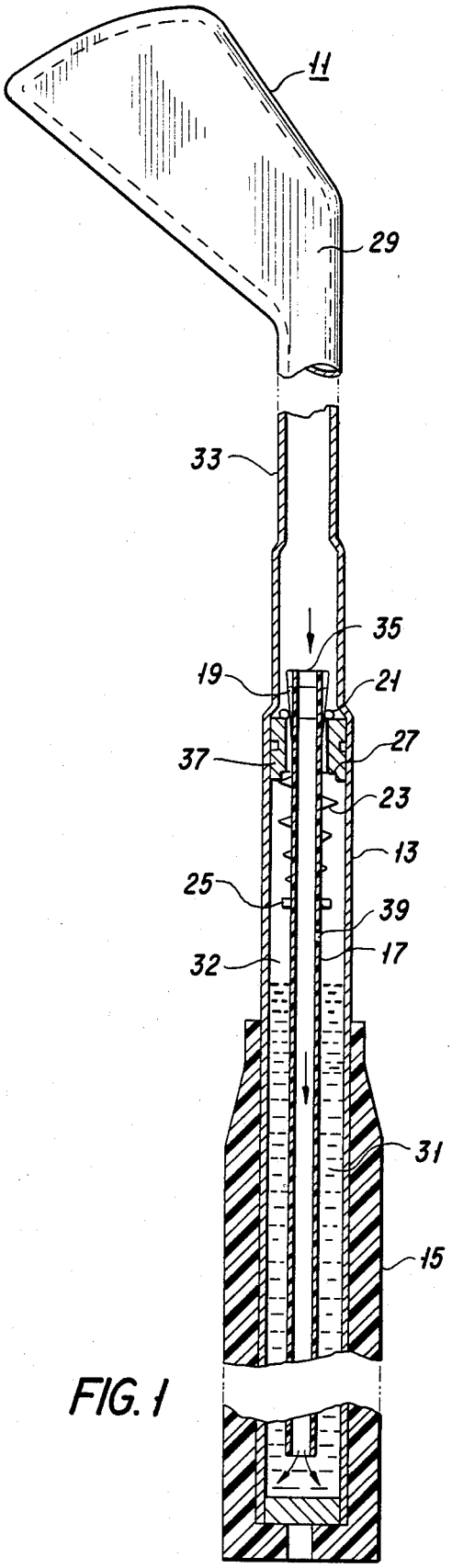

Looking now at FIG. 1, the golf club, generally indicated by 11, has upper shaft portion 13, usually equipped with a grip, such as 15. The internal portion of shaft 13 is hollow and has a means of moving or redistributing weight within the club. As shown the redistributing means is comprised of a valve assembly, namely, valve tube 17 connected to valve 19 which is received in fixed valve seat 21. Valve 19 is urged toward seat 21 by spring 23 exerting expanding force between fixed spring stop 25 and surface 27 of hollow retainer 37. As shown valve seat 21 is an insert into retainer 37, however it will be understood that a surfaced portion of hollow retainer 37 may serve as a valve seat.

The club, as shown in FIG. 1, is in the normally grip-down position as it would be stored in a golf bag. A flowable medium 31 is shown residing within the hollowed, upper shaft position 13. Although the flowable weight medium may be selected from finely-divided solid materials, such as, powdered metals, graphite or glass, it is preferred that the flowable medium be liquid, or partially liquid. By partially liquid is meant suspensions, or slurries of solids in a liquid. The arrows in FIG. 1 show the path that the flowable weight medium 31 took in moving through chamber 32 formed by the sealed hollow portion of head 29 and the hollow portion of shaft 13. The path of the weight is from the hollow of head 29, through the hollow lower shaft portion 33, through orifice 35 in valve 19 and through valve tube 17. Valve tube 17 has vent 39 therein to aid in venting air from hollowed upper shaft portion 13 as weight medium 31 fills such hollowed upper shaft portion.

The valve and retainer components of the present invention may be fabricated of any suitable material such as metals or plastics, or mixtures thereof. Plastic materials have been found to be particularly useful. Weight medium 31 is preferably liquid, or partially liquid, for example, mercury, oil or solid suspensions in light oils are useful, however, halogenated materials such as chlorinated and fluorinated methanes, ethanes and propanes, such as those presently marketed by DuPont Company under the designation "Freon" have been found to be particularly suited to use.

Figure 2:
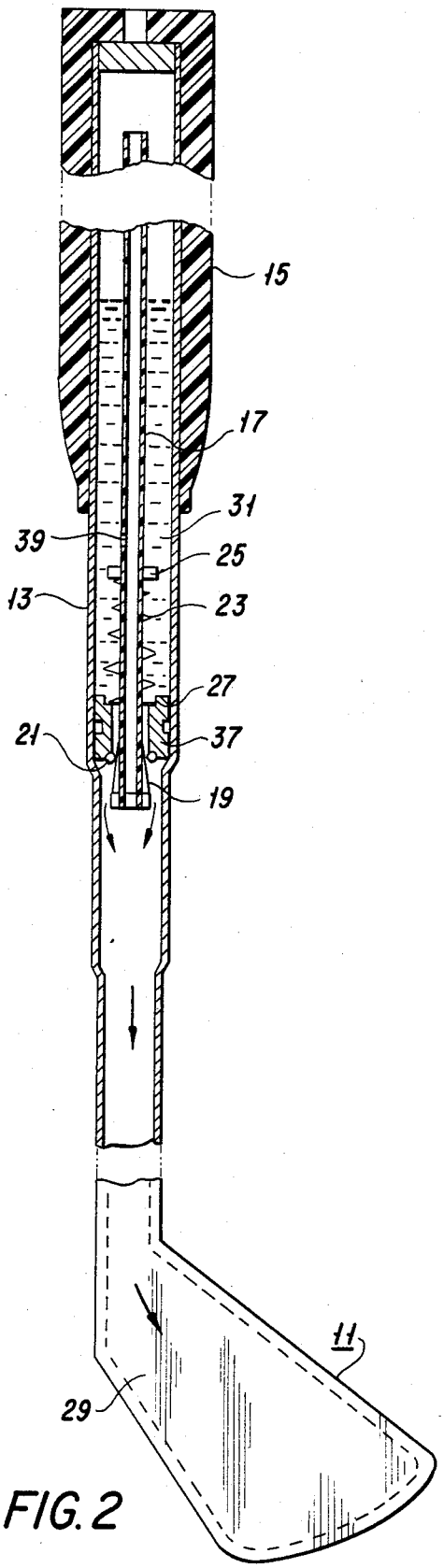
FIG. 2 is a similar view showing the club before the stroke has been taken.

FIG. 2 illustrates movement of the flowable weight medium within the club. If the club shown in FIG. 1 is turned so that the head 29 is downward, the normal position of use, valve 19 seated against valve seat 21 prevents passage of the flowable medium. As the club head is swung, valve 19 is moved toward club head 29 by inertia and centrifugal force allowing flowable medium 31 to move rapidly from hollowed shaft portion 13 through the hollow in retainer 37 through the hollowed shaft portions 13 and 33 into hollowed head 29. Arrows in FIG. 2 show the path of flowable medium 31 as it travels through the club.

Figure 3:
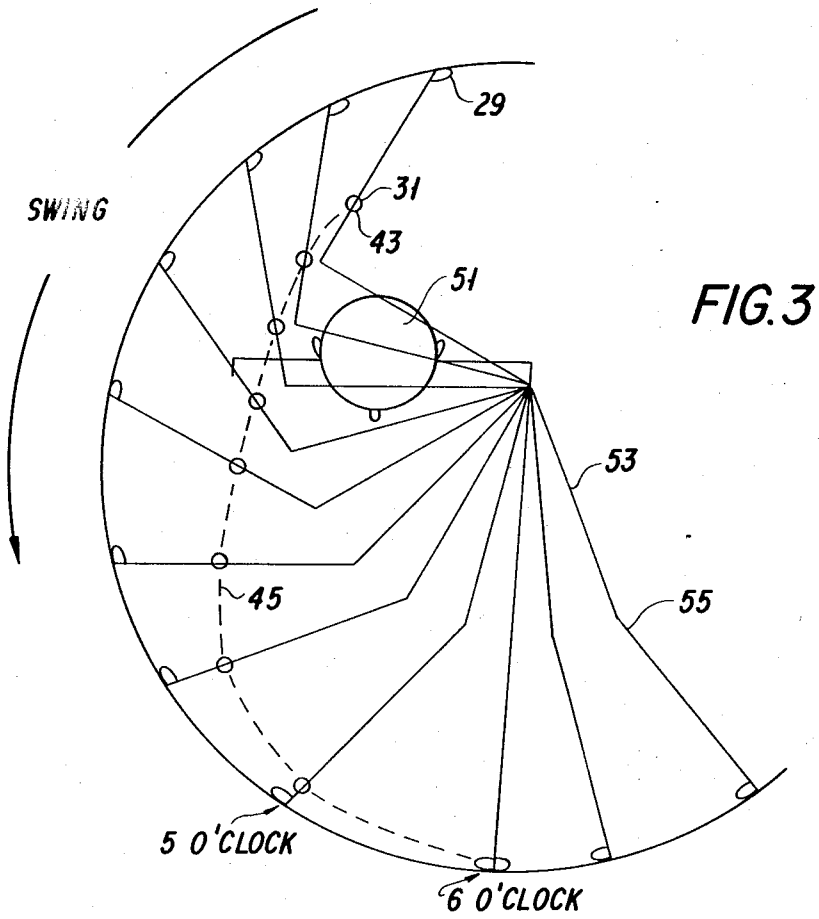
FIG. 3 illustrates the arc of the swing as circumscribed by the club head and shows the progressive movement by inertia and centrifugal force of the moveable weight within the club.

FIG. 3 illustrates a swing arc 41 as would be circumscribed by the movement of club head 29 and shows the path of flowable weight as the club is swung. Although there are a number of fulcrum points in the golfer's body used to swing a golf club, e.g., the legs, hips, shoulders, arms and wrists, FIG. 3, for simplicity and to illustrate the present invention shows only the left arm and wrist movements of the golfer's swing. Thus golfer 51 has left arm 53 and wrist 55. As golfer 51 starts his swing moveable weight 31 starts at a point 43 near the golfer's grip and proceeds, as the club is swung, along path 45 to club head 29. Preferably movable weight 31 reaches head 29 at a point about 5 o'clock, as the arc would be viewed by golfer 51 and contact with the ball will be at about 6 o'clock.

The present invention is particularly adapted to used in the so-called "woods", e.g., drivers, brassies, spoons and cleeks, which generally range in club length from about 41 to about 44 inches and range in over-all weight from about 12 to about 14 ounces. In such clubs the moveable weight of the present invention generally ranges from about 0.75 to about 2.00 ounces, and most preferably from about 1.00 about 1.50 ounces. The so-called "irons", generally range from about 35 to about 40 inches in length and have over-all weights ranging from about 14.5 to about 17.5 ounces. The weight range of the present moveable weight is in the same range as that for woods, although in the case of irons the moveable weight may remain in the shaft portion of the club.

The present invention may be adapted to a specific golfer's swing, although this is not usually needed. For example the flowability, or the amount of moveable weight may be varied. The position of valve 19 may be varied within the shaft. The hollow in retainer 37 may be increased or decreased. The tension of spring 23 may be varied. The weight of valve 19 may be altered. Although the foregoing adaptations may be made, it has been found that when the valve 19 is positioned from about 15 to about 17 inches from the grip end of the club and with spring tension just sufficient to retain the weight medium in the upper portion of the club prior to the club swing, that the present arrangement adapts itself to the golfer's swing by the combination of gravity, inertia and centrifugal force.

The foregoing description and embodiments are intended to illustrate the invention without limiting it thereby. It will be understood that various modifications can be made in the invention without departing from the spirit or scope thereof.

I claim:

1. A golf club having a hollow head portion connected to a hollow shaft portion, forming an enclosed internal chamber within the club, a flowable weight moveable within said chamber, a valve for preventing said flowable weight from passing from said shaft portion into said hollow head portion, said valve including means for allowing said flowable weight to flow from said hollow shaft portion into said hollow head portion, said last named means being actuable by centrigual force acting thereon during the downswing of a golf club.

2. The golf club of claim 1 wherein said flowable weight is a liquid.

3. The golf club of claim 1 wherein said flowable weight ranges from 0.75 to 2.00 ounces.

* * * * *